US010654043B2

(12) United States Patent
Irmak et al.

(10) Patent No.: US 10,654,043 B2
(45) Date of Patent: May 19, 2020

(54) WEAR-RESISTANT ELEMENT FOR A COMMINUTING DEVICE

(71) Applicants: THYSSENKRUPP INDUSTRIAL SOLUTIONS AG, Essen (DE); thyssenkrupp AG, Essen (DE)

(72) Inventors: Baris Irmak, Beckum (DE); Ingo Neitemeier, Ennigerloh (DE); Marc Tigges, Ahlen (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 16/068,169

(22) PCT Filed: Jan. 12, 2017

(86) PCT No.: PCT/EP2017/050516
§ 371 (c)(1),
(2) Date: Jul. 5, 2018

(87) PCT Pub. No.: WO2017/125301
PCT Pub. Date: Jul. 27, 2017

(65) Prior Publication Data

US 2019/0015837 A1 Jan. 17, 2019

(30) Foreign Application Priority Data

Jan. 22, 2016 (DE) ..... 10 2016 200 911

(51) Int. Cl.
*B02C 4/30* (2006.01)
*B02C 15/00* (2006.01)
*B02C 4/08* (2006.01)

(52) U.S. Cl.
CPC ..... *B02C 4/305* (2013.01); *B02C 4/08* (2013.01); *B02C 15/005* (2013.01); *B02C 2210/02* (2013.01)

(58) Field of Classification Search
CPC ..... B02C 4/305; B02C 4/08; B02C 15/005; B02C 2210/02; B02C 4/30; B02C 13/28
(Continued)

(56) References Cited

U.S. PATENT DOCUMENTS 6,290,008 B1 9/2001 Portwood
6,706,319 B2 * 3/2004 Seth ..... B24D 18/00 427/190
(Continued)

FOREIGN PATENT DOCUMENTS

CL 2016-01562 12/2016
CL 2018-01964 11/2018
(Continued)

OTHER PUBLICATIONS

English Translation of International Search Report issued in PCT/EP2017/050516, dated Mar. 6, 2017 (dated Mar. 15, 2017).

*Primary Examiner* — Shelley M Self
*Assistant Examiner* — Katie L. Parr
(74) *Attorney, Agent, or Firm* — thyssenkrupp North America, LLC.

(57) ABSTRACT

A wear-resistant element for partial insertion into a recess on the surface of a wear area of a comminuting device. The wear-resistant element includes particles made of a highly wear-resistant material which are embedded in a matrix material.

14 Claims, 4 Drawing Sheets

(58) Field of Classification Search
USPC ..... 241/294, 197, 300
See application file for complete search history.

(56) References Cited

U.S. PATENT DOCUMENTS

| | | | | |
|---|---|---|---|---|
| 7,753,303 | B2 * | 7/2010 | Hall | B02C 13/1842 241/275 |
| 8,020,640 | B2 * | 9/2011 | Lockwood | C22C 26/00 175/431 |
| 8,911,522 | B2 * | 12/2014 | Cleboski | B24D 99/005 51/293 |
| 10,155,226 | B2 * | 12/2018 | Frangenberg | B02C 4/305 |
| 2011/0008569 | A1 * | 1/2011 | Madok | B02C 4/305 428/99 |
| 2012/0312907 | A1 * | 12/2012 | Gronvall | B02C 4/305 241/30 |
| 2015/0034749 | A1 * | 2/2015 | De Weldige | B02C 4/02 241/220 |
| 2017/0348694 | A1 * | 12/2017 | Olsson | B02C 4/305 |
| 2018/0071743 | A1 * | 3/2018 | Olsson | B02C 2/005 |
| 2018/0305598 | A1 * | 10/2018 | Fan | B24D 18/00 |

FOREIGN PATENT DOCUMENTS

| | | | |
|---|---|---|---|
| DE | 102006010042 | A | 9/2007 |
| DE | 1 020 111 02 386 | C | 3/2015 |
| EP | 2940169 | A | 11/2015 |
| WO | 2016150719 | A | 9/2016 |

* cited by examiner

WEAR-RESISTANT ELEMENT FOR A COMMINUTING DEVICE

CROSS REFERENCE TO RELATED APPLICATIONS

This application is a U.S. National Stage Entry of International Patent Application Serial Number PCT/EP2017/050516, filed Jan. 12, 2017, which claims priority to German Patent Application No. DE 10 2016 200 911.7, filed Jan. 22, 2016, the entire contents of both of which are incorporated herein by reference.

FIELD

The present disclosure generally relates to a wear-resistant element for partial insertion into a recess on the surface of a wear area of a comminuting device.

BACKGROUND

In the case of comminuting devices, such as grinding rollers, used in particular for material-bed comminution of, for example, hard ore, operation of the comminuting device gives rise to a high degree of wear of the surface of a wear area, such as for example the grinding roller surface. In order to counteract this wear, it is known from DE 2006 010 042 A1, for example, to apply additional wear-resistant elements to the surface of the grinding roller. Given a certain degree of wear, it is necessary to replace the wear-resistant elements of the grinding roller in order to guarantee efficient grinding. By way of example, the replacement of the wear-resistant elements leads to long downtimes of the roller mill, and also high maintenance costs.

Thus a need exists for a wear-resistant element having a high wear resistance, in order to increase the maintenance intervals for replacing the wear-resistant elements.

DETAILED DESCRIPTION

Figures 1, 2:
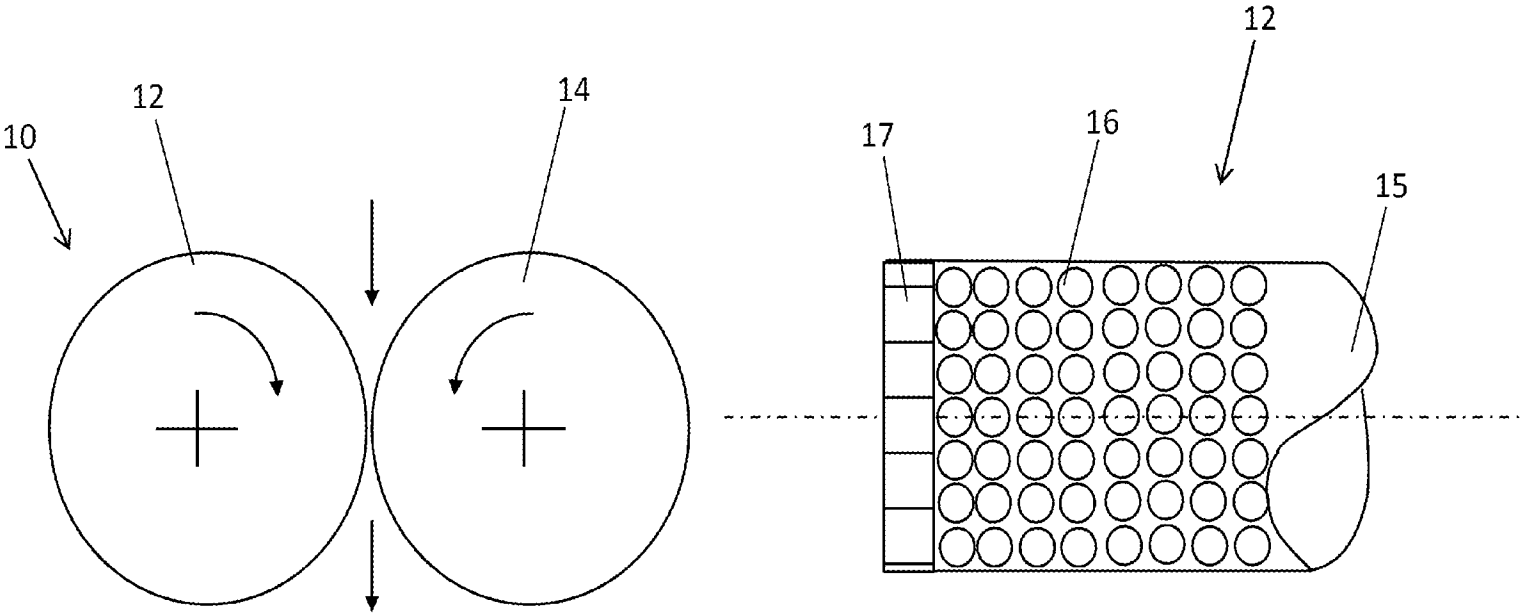
FIG. 1 is a schematic front view of a roller mill according to one exemplary embodiment.
FIG. 2 is a schematic view of a grinding roller of the roller mill as shown in FIG. 1.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to a wear-resistant element for partial insertion into a recess on the surface of a wear area of a comminuting device, and also to be a comminuting device including such a wear-resistant element.

According to a first aspect, a wear-resistant element for partial insertion into a recess on the surface of a wear area of a comminuting device, in particular of a grinding roller of a roller mill, comprises particles made of a highly wear-resistant material which are embedded in a matrix material. In particular, the particles have a higher wear resistance than the matrix material in which they are embedded. The term "embedded" is to be understood as meaning that the highly wear-resistant particles are surrounded at least partially by the matrix material. The particles are preferably embedded in the matrix in such a manner that a substance-to-substance bond is formed between the matrix material and the particles. In particular, the particles have a size of 2μ to 5 mm, preferably 5μ-2 mm.

By way of example, the comminuting device is a roller mill, a roller crusher, a cone crusher, a hammer mill or a vertical roller mill, the wear area being in particular the surface of a grinding roller or of a crushing cone, the hammer tools and the surface of the grinding track of a hammer mill, or the surface of the rollers and of the grinding table of a vertical roller mill, which are exposed to a high degree of wear during operation of the comminuting device.

By way of example, the wear-resistant element has a cylindrical form or has a square cross section. In particular, one end of the wear-resistant elements is formed in such a manner that it can be fastened to the surface of the wear area, in particular in a recess in the surface of the wear area. In particular, the wear-resistant element has a plate-shaped form. This is advantageous particularly when such a wear-resistant element is employed on, for example, a grinding track of a hammer mill or a vertical roller mill.

The wear resistance of the wear-resistant element is determined in particular by the distribution density of the particles within the matrix material. Particles embedded in a matrix material therefore allow for simple production of wear-resistant elements of differing wear resistance, with the distribution density of the particles within the matrix material being varied for different wear-resistant elements, such that wear-resistant elements exposed to a higher degree of wear, for example at the end edges of the grinding roller, have a higher distribution density of the particles.

According to a first embodiment, the matrix material comprises tungsten carbide. Tungsten carbide has a high wear resistance and is readily suitable as matrix material for embedding highly wear-resistant particles, since the high wear resistance prevents the diamond particles from being washed out.

According to a further embodiment, the highly wear-resistant material of the particles comprises diamond, ceramic or titanium. The aforementioned materials have a very high wear resistance, and, particularly embedded in a tungsten carbide matrix, considerably increase the wear resistance and therefore the service life of a wear-resistant element of a roller mill.

According to a further embodiment, the particles made of highly wear-resistant material are distributed uniformly in the matrix material or are concentrated at a selected position within the matrix material. In particular, the proportion of the particles within the matrix material amounts to a concentration of 20% to 80%, preferably 35%-65%. A uniform distribution of the particles within the matrix material affords the advantage of uniform wear of the wear-resistant element during operation of the comminuting device, with an increased concentration of particles in a specific region within the matrix material affording the advantage of a local increase in the wear resistance of the wear-resistant element. In particular, this makes it possible to provide regions exposed to a particularly high degree of wear with a higher distribution density of the particles.

According to a further embodiment, the wear-resistant element comprises a core region and a shell region which at least partially surrounds the core region, wherein the particles made of the highly wear-resistant material are arranged exclusively in the core region. The shell region preferably has a tubular form, such that the core region extends over the entire length of the wear-resistant element. The core region preferably has a cylindrical form, with the end faces of the wear-resistant element comprising the shell region and the core region.

In order to fit the wear-resistant elements into a recess in the surface of the wear area, it is often necessary to machine the surfaces of the wear-resistant elements, for example by grinding. A shell region in which there are no highly wear-resistant particles allows for simple machinability of the wear-resistant element.

According to a further embodiment, the shell region is formed from tungsten carbide or a steel alloy.

According to a further embodiment, the shell region and the core region are bonded, in particular sintered, to one another substance-to-substance. This increases the wear resistance and fracture strength of the wear-resistant element.

According to a further embodiment, the particles made of the highly wear-resistant material are arranged in the core region in such a manner that the particle distribution density rises in the direction of the shell region. This allows for a concentration of the particles in the marginal region of the core region, with a lower number of particles, or for example even no particles, being arranged in the inner region of the core region. This achieves a reduction in the costs for producing the wear-resistant elements, since the number of particles in the wear-resistant element is reduced overall.

According to a further embodiment, the wear-resistant element comprises a fastening region, which can be connected to the recess in the surface of the wear area, and a wear region, which protrudes at least partially out of the surface of the wear area. In the position of the wear-resistant element arranged in the recess in the wear area, the fastening region is arranged in particular radially inward of the wear region, and is connected to the grinding roller. The fastening region is formed in particular in such a manner that it does not protrude at all or protrudes only to a very small extent out of the recess in the wear area, such that replacement of the wear-resistant element in the case of wear is necessary except for the length of the fastening region. In particular, the particle distribution within the wear region rises in the direction of the surface of the wear region, in particular the surface of the wear-resistant element.

According to a further embodiment, exclusively the wear region comprises the particles made of highly wear-resistant material which are embedded in the matrix material. This makes it possible to reduce the costs for producing the wear-resistant element, since the fastening region does not comprise any particles.

According to a further embodiment, the wear-resistant element comprises a cutout on the end face, in particular a borehole. The cutout is preferably formed in the fastening region, on the end face facing toward the wear area of the comminuting device. By way of example, the cutout has a round or a square cross section and is arranged coaxially with respect to the wear-resistant element. The cutout is arranged in the end face of the wear-resistant element, in particular the end face facing toward the wear area. Such a cutout makes it possible to save material and therefore to achieve a considerable reduction in the costs for the wear-resistant element.

According to a further embodiment, the fastening region comprises a material which has a lower wear resistance than the material of the wear region. This likewise achieves a reduction in the costs for the wear-resistant element.

According to a further embodiment, the fastening region has a sleeve-shaped form and the wear region is arranged within the sleeve-shaped region of the fastening region. The sleeve-shaped formation of the fastening region allows for particularly simple production of the fastening region. The wear region preferably has a particle distribution density which rises in the direction of the surface of the wear region, such that the greatest number of highly wear-resistant particles is arranged on the surface. In particular, the particle distribution density rises in the direction of the outer marginal region of the wear-resistant element, which protrudes out of the wear area.

According to a further embodiment, the fastening region and the wear region are bonded, in particular adhesively bonded or soldered, to one another substance-to-substance.

According to a further embodiment, the fastening region comprises less than 45%, preferably less than 30%, most preferably less than 20% of the wear-resistant element.

According to a further embodiment, the wear region extends level with the wear-resistant element at least partially beyond the fastening region.

The invention furthermore encompasses a comminuting device comprising a wear-resistant element as described above, wherein the wear-resistant element is mounted at least partially in a recess in the surface of the wear area.

According to a further embodiment, the fastening region of the wear-resistant element is bonded, in particular welded, adhesively bonded or soldered, to the wear area of the comminuting device substance-to-substance.

In particular, the comminuting device comprises a grinding and/or crushing assembly.

The advantages described with reference to the wear-resistant element also apply to a comminuting device comprising such a wear-resistant element.

FIG. 1 schematically shows a roller mill 10. The roller mill 10 comprises two grinding rollers 12, 14, which are shown schematically as circles and have the same diameter and are arranged alongside one another. A grinding gap, of adjustable size for example, is located between the grinding rollers 12, 14.

During operation of the roller mill, the grinding rollers 12, 14 rotate counter to one another in a direction of rotation shown by the arrows, with grinding material passing through the grinding gap in the falling direction and being ground.

FIG. 2 shows an end region of a grinding roller 12 having a roller main body 15 on which wear-resistant elements 16 are mounted. The wear-resistant elements 16 are mounted in the outer circumference of the surface of the grinding roller. By way of example, the wear-resistant elements 16 shown in FIG. 2, which are spaced apart from one another and arranged next to one another, have a circular cross section. It is likewise conceivable for the wear-resistant elements 16 to vary in relation to one another over the surface of the grinding roller in terms of size, number, cross-sectional shape and arrangement, in order, for example, to compensate for local differences in wear during operation of the grinding roller 12, 14.

Furthermore, the grinding roller 12 comprises wear-resistant corner elements 17, which are mounted at the end thereof and, for example, have a rectangular cross section and are arranged alongside one another in a row in such a manner that they form a ring over the circumference of the grinding roller 12. Further cross-sectional shapes of the wear-resistant corner elements 17 which differ from the cross-sectional shape shown in FIG. 2 are moreover conceivable. It is also possible for the wear-resistant corner elements 17 to be arranged in a manner spaced apart from one another. FIG. 2 shows by way of example only the left-hand end of the grinding roller 12, with the right-hand end (not shown) advantageously being of identical structure.

Figure 3:
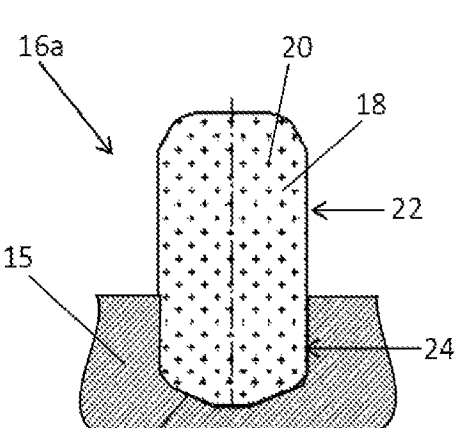
FIG. 3 is a schematic cross-sectional view of an exemplary embodiment of wear-resistant elements.

FIG. 3 shows a wear-resistant element 16*a* arranged in a recess 32 in the roller main body 15 of a grinding roller 12, 14 as shown in FIGS. 1 and 2. The wear-resistant element comprises a fastening region 24 and a wear region 22, the fastening region being arranged in the recess 32 on the surface of the grinding roller 12, 14 and being connected to the roller main body 15 of the grinding roller 12, 14. By way of example, the wear-resistant element 16*a* at the fastening region 24 is bonded to the recess in the surface of the roller main body 15 of the grinding roller 12, 14 substance-to-substance, in particular welded, soldered or adhesively bonded, or connected thereto in a form-fitting manner, in particular screwed or wedged. The wear region 22 of the wear-resistant element 16*a* is arranged at least partially outside the recess 32 in the roller main body 15, such that it protrudes out of the roller main body 15 in the radial direction of the grinding roller (not shown). In the exemplary embodiment illustrated, the fastening region comprises approximately one third of the entire wear-resistant element 16*a*, with the wear region comprising approximately the further two thirds.

The wear-resistant element 16*a* comprises a matrix material 18, in which a plurality of particles 20 are arranged. The particles 20 are arranged in a manner distributed uniformly in the matrix material 18. The wear region 22 and the fastening region 24 have the same particle distribution in the matrix material.

The particles 20 are in particular a highly wear-resistant material comprising, for example, diamond, ceramic or titanium. By way of example, the matrix material 18 comprises tungsten carbide. The particles 20 are in particular bonded substance-to-substance, for example by sintering, to the matrix material 18.

During operation of the roller mill, the wear-resistant elements 16*a* are exposed to a high degree of wear, where in particular the wear region 22 of the wear-resistant elements 16*a* which protrudes out of the surface of the grinding roller 12, 14 becomes worn. The highly wear-resistant particles 20 in the matrix material 18 reduce the wear of the wear-resistant elements 16*a* considerably, with the number of particles 20, in particular the distribution density of the particles 20, in the matrix material 18 increasing the wear resistance of the wear-resistant element 16*a*.

Figure 4:
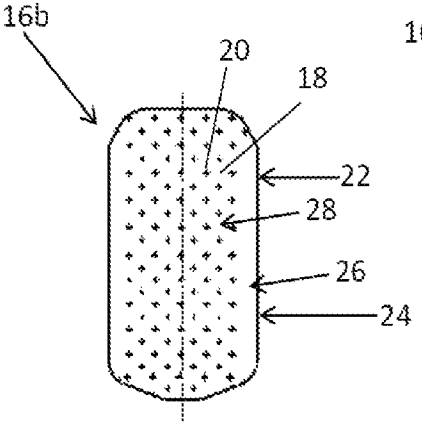
FIG. 4 is a schematic cross-sectional view of an exemplary embodiment of wear-resistant elements.

FIG. 4 shows a further exemplary embodiment of a wear-resistant element 16, in which the roller main body 15 with the recess 32, in which the wear-resistant element 16*b* is arranged, is not shown. The wear-resistant element 16*b* shown in FIG. 4 corresponds substantially to the wear-resistant element 16*a* shown in FIG. 3, and comprises the fastening region 24 and the wear region 22, which are described with reference to FIG. 3 and are arranged in a manner corresponding to FIG. 3. In contrast to FIG. 3, FIG. 4 includes a core region 28 and a shell region 26 surrounding the circumference of the core region 28. The core region 28 extends in the longitudinal direction of the wear-resistant element 16*b* from one end of the wear-resistant element 16*b* to the other end of the wear-resistant element 16*b*. The shell region 26 has a substantially tubular form and surrounds the circumference of the core region 28. In the exemplary embodiment shown in FIG. 4, the particles 20 are arranged in a manner distributed uniformly exclusively in the core region 28 of the wear-resistant element 16*b* and within the core region 28. The shell region 26 does not comprise any particles 20. By way of example, the shell region 26 comprises the matrix material 18 tungsten carbide or for example a steel alloy.

Figure 5:
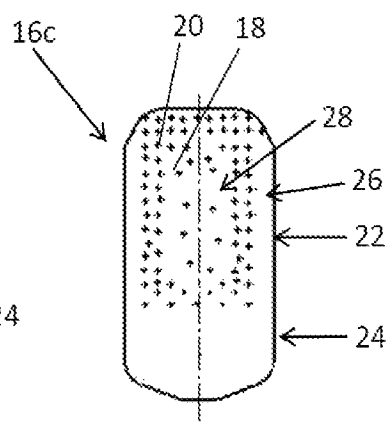
FIG. 5 is a schematic cross-sectional view of an exemplary embodiment of wear-resistant elements.

FIG. 5 shows a further exemplary embodiment of a wear-resistant element 16*c*, this corresponding substantially to the wear-resistant element 16*b* shown in FIG. 4, with the difference that the wear-resistant element 16*c* does not comprise any particles 20 in the fastening region 24. The particles 20 are arranged exclusively in the core region 28 of the wear region 22 of the wear-resistant element 16*c*. The particles 20 are arranged distributed in the core region 28 of the wear region 22 in such a manner that the density of the particle distribution increases in the direction of the shell region 26, such that the highest particle distribution density is arranged at the boundary region between the core region 28 and the shell region 26. The particle distribution density furthermore increases in the longitudinal direction of the wear-resistant element 16*c*, in particular in the radial direction of the grinding roller outward.

Figure 6:
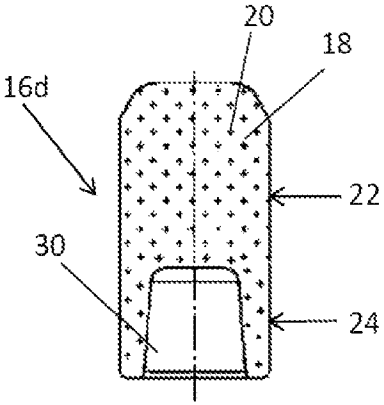
FIG. 6 is a schematic cross-sectional view of an exemplary embodiment of wear-resistant elements.

FIG. 6 shows a wear-resistant element 16*d*, this corresponding substantially to the wear-resistant element 16*a* shown in FIG. 3, with the difference that the wear-resistant element 16*d* comprises a cutout 30 in the fastening region 24 thereof. The cutout 30 is made in the end face of the fastening region 24 and, for example, has a cylindrical or conical form, and extends over the entire fastening region, in particular coaxially in relation to the wear-resistant element 16*d*. By way of example, the cutout 30 serves for fastening the wear-resistant element 16*d* in the recess 32 in the roller surface. Furthermore, the cutout gives rise to a considerable saving of material.

Figure 7:
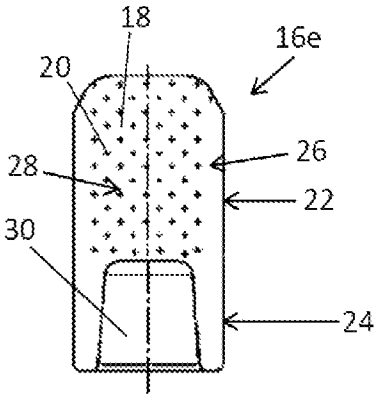
FIG. 7 is a schematic cross-sectional view of an exemplary embodiment of wear-resistant elements.

FIG. 7 shows a wear-resistant element 16*e*, this corresponding substantially to the wear-resistant element 16*d* shown in FIG. 6, with the difference that the wear-resistant element 16*e* comprises a shell region 26 and a core region 28 as shown in FIG. 4, with the fastening region not comprising any particles 20.

Figure 8:
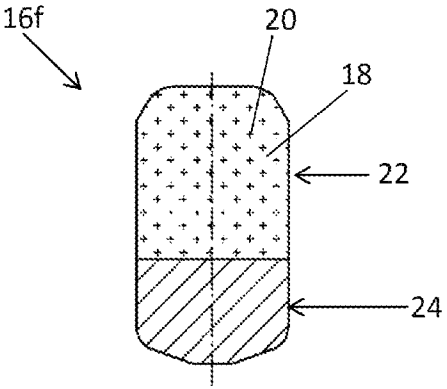
FIG. 8 is a schematic cross-sectional view of an exemplary embodiment of wear-resistant elements.

FIG. 8 shows a wear-resistant element 16*f* corresponding substantially to the wear-resistant element 16*a* shown in FIG. 3, with the fastening region 24 being formed from a different material to the wear region 22. By way of example, the fastening region 24 is formed from a softer, in particular less wear-resistant material than the wear region. By way of example, the fastening region comprises a steel. The fastening region 24 and the wear region 22 are in particular bonded to one another substance-to-substance, for example adhesively bonded, welded or soldered. It is likewise conceivable to form the wear-resistant element 16*f* in a plate-shaped manner, in which case the fastening region and the wear region have a plate-shaped form. A plate-shaped formation of the wear-resistant element is suitable in particular when used for providing a grinding track with wear resistance.

Figure 9:
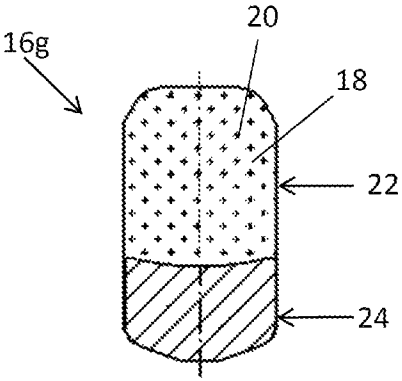
FIG. 9 is a schematic cross-sectional view of an exemplary embodiment of wear-resistant elements.

FIG. 9 shows a wear-resistant element 16*g* corresponding substantially to the wear-resistant element 16*f* shown in FIG. 8, with that end of the fastening region 24 of the wear-resistant element 16*g* which faces toward the wear region 22 comprising an inwardly pointing bulge. This bulge serves for positioning the wear region 22 on the fastening region 24.

Figure 10:
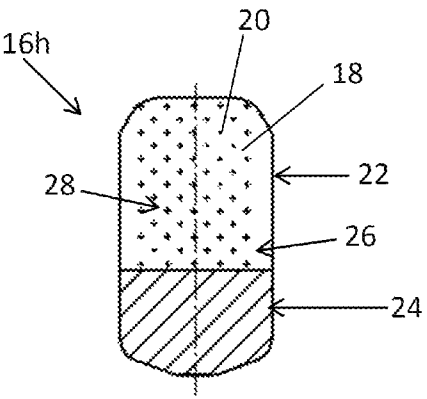
FIG. 10 is a schematic cross-sectional view of an exemplary embodiment of wear-resistant elements.

FIG. 10 shows a wear-resistant element 16*h* corresponding substantially to the wear-resistant element 16*f* shown in FIG. 8, with the wear region 22 comprising a core region 28 and a shell region 26 surrounding the core region 28 as shown in FIG. 4 and FIG. 7.

Figure 11:
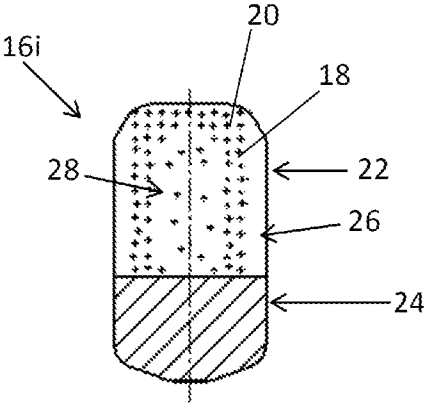
FIG. 11 is a schematic cross-sectional view of an exemplary embodiment of wear-resistant elements.

FIG. 11 shows a wear-resistant element 16*i* corresponding substantially to the wear-resistant element 16*f* shown in FIG. 8, with the wear region 22 comprising a core region 28 and a shell region 26 surrounding the core region 28 as shown in FIG. 5.

Figure 12:
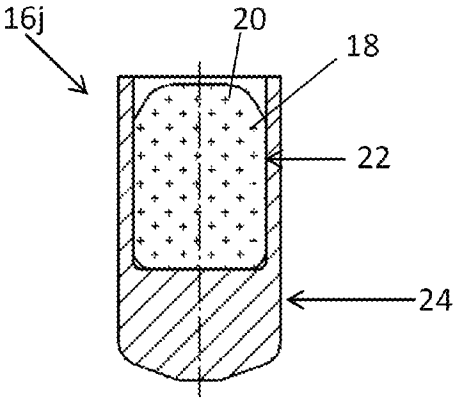
FIG. 12 is a schematic cross-sectional view of an exemplary embodiment of wear-resistant elements.

FIG. 12 shows a wear-resistant element 16*j* comprising a substantially sleeve-shaped fastening region 24, the latter extending over the entire length of the wear-resistant element 16*j* and the wear region 22 being arranged within the sleeve-shaped fastening region 24. By way of example, the sleeve-shaped fastening region 24 is formed from a softer, less wear-resistant material than the wear region 22. The material of the wear region 22 corresponds to the material described with reference to FIGS. 3, 6, 8 and 9.

Figure 13:
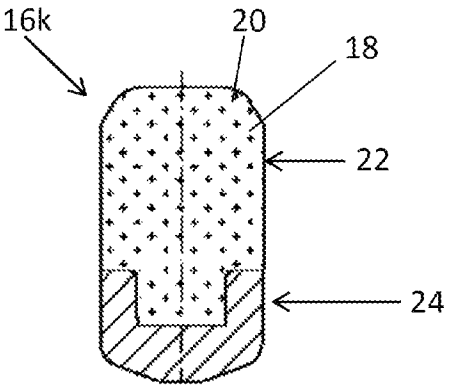
FIG. 13 is a schematic cross-sectional view of an exemplary embodiment of wear-resistant elements.

FIG. 13 shows a wear-resistant element 16*k* corresponding substantially to the wear-resistant element 16*f* shown in FIG. 8, with that region of the fastening region 24 of the wear-resistant element 16*k* which faces toward the wear region 22 comprising a cutout which interacts with a projection in that region of the wear-resistant region 22 which faces toward the fastening region 24. Such a cutout in the fastening region serves in particular for positioning the wear region on the fastening region, with the wear region being centered in relation to the fastening region 24. By way of example, the cutout has a cylindrical form and is formed so as to be centered.

Figure 14:
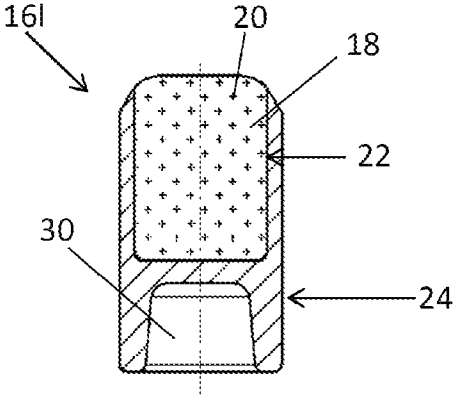
FIG. 14 is a schematic cross-sectional view of an exemplary embodiment of wear-resistant elements.

FIG. 14 shows a wear-resistant element 161 corresponding substantially to the wear-resistant element 16*j* shown in FIG. 12, with a cutout 30 as shown in FIGS. 6 and 7 being arranged in the fastening region 24.

Figure 15:
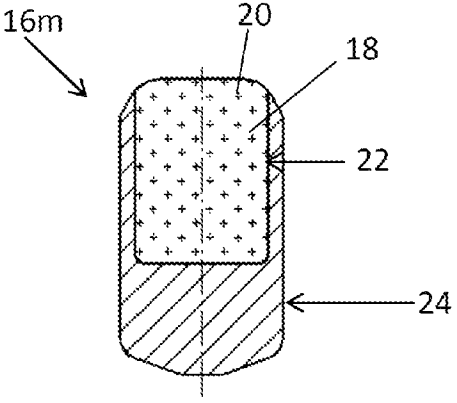
FIG. 15 is a schematic cross-sectional view of an exemplary embodiment of wear-resistant elements.

FIG. 15 shows a wear-resistant element 16*m* corresponding substantially to the wear-resistant element 16*j* shown in FIG. 12, with the wear region 22 extending beyond the sleeve-shaped fastening region 24.

What is claimed is:

1. A comminuting device, comprising:

a roller main body comprising a wear area including a recess formed in a surface of the wear area;

a wear-resistant element configured to be partially inserted into the recess, the wear-resistant element comprising:

a core region; and a shell region surrounding some or all of the core region;

wherein both the core region and the shell region are composed of a matrix material comprising tungsten carbide; and particles of diamond, ceramic, or titanium, embedded exclusively in the core region.

2. The comminuting device of claim 1, wherein the particles of diamond, ceramic, or titanium are distributed uniformly in the matrix material or are concentrated at a selected position within the matrix material.

3. The comminuting device of claim 1, wherein the shell region and the core region are bonded to one another.

4. The comminuting device of claim 1, wherein the shell region and the core region are sintered to one another.

5. The comminuting device of claim 1, wherein the particles of diamond, ceramic, or titanium are arranged in the core region in such a manner that a particle distribution density rises with proximity to the shell region.

6. The comminuting device of claim 1, comprising:

a fastening region, which is configured to connect to the recess on the surface of the wear area of the comminuting device; and a wear region, which protrudes at least partially out of the surface of the wear area of the comminuting device.

7. The comminuting device of claim 6, wherein exclusively the wear region comprises the particles of diamond, ceramic, or titanium which are embedded in the matrix material.

8. The comminuting device of claim 6, wherein an end face of the wear-resistant element comprises a cutout.

9. The comminuting device of claim 6, wherein a material of the fastening region has a lower wear resistance than a material of the wear region.

10. The comminuting device of claim 6, wherein the fastening region has a sleeve-shaped form, wherein the wear region is arranged within the sleeve-shaped form of the fastening region.

11. The comminuting device of claim 7, wherein the fastening region and the wear region are bonded to one another.

12. The comminuting device of claim 7, wherein the fastening region and the wear region are adhesively bonded or soldered to one another.

13. The comminuting device of claim 7, wherein the fastening region comprises less than 45% of the wear-resistant element.

14. The comminuting device of claim 1, wherein a fastening region of the wear-resistant element is bonded to the recess.

* * * * *